US009157247B2

(12) United States Patent
Korevaar

(10) Patent No.: US 9,157,247 B2
(45) Date of Patent: Oct. 13, 2015

(54) MASON'S SPEED SQUARE

(71) Applicant: Peter Korevaar, Cookstown (CA)

(72) Inventor: Peter Korevaar, Cookstown (CA)

( * ) Notice: Subject to any disclaimer, the term of this patent is extended or adjusted under 35 U.S.C. 154(b) by 140 days.

(21) Appl. No.: 13/776,202

(22) Filed: Feb. 25, 2013

(65) Prior Publication Data

US 2013/0219730 A1 Aug. 29, 2013

Related U.S. Application Data

(60) Provisional application No. 61/602,258, filed on Feb. 23, 2012.

(51) Int. Cl.

| | |
|---|---|
| ***E04G 21/22*** | (2006.01) |
| ***E04G 21/16*** | (2006.01) |
| ***B25H 7/02*** | (2006.01) |
| *B43L 7/027* | (2006.01) |

(52) U.S. Cl.
CPC *E04G 21/22* (2013.01); *B25H 7/02* (2013.01); *E04G 21/16* (2013.01); *B43L 7/027* (2013.01)

(58) Field of Classification Search
CPC ..... E04G 21/22; E04G 21/16; B43L 7/027
USPC ..... 33/518, 404, 408, 411, 415, 429, 485, 33/489, 563
See application file for complete search history.

(56) References Cited

U.S. PATENT DOCUMENTS

| | | | | |
|---|---|---|---|---|
| 387,966 | A * | 8/1888 | Beckwith | 33/429 |
| 4,277,927 | A * | 7/1981 | Richter | 52/749.13 |
| 4,573,276 | A * | 3/1986 | Torczon | 33/481 |
| 5,396,710 | A * | 3/1995 | Battaglia | 33/429 |
| 6,049,990 | A * | 4/2000 | Holland | 33/464 |
| 7,975,395 | B2 * | 7/2011 | Keller et al. | 33/451 |
| 8,307,564 | B1 * | 11/2012 | Heaton | 33/527 |
| 2009/0013546 | A1 * | 1/2009 | Keller et al. | 33/451 |
| 2013/0219730 | A1 * | 8/2013 | Korevaar | 33/518 |
| 2013/0318804 | A1 * | 12/2013 | Harris | 33/342 |

* cited by examiner

*Primary Examiner* — Yaritza Guadalupe-McCall
(74) *Attorney, Agent, or Firm* — Head, Johnson & Kachigian, P.C.

(57) ABSTRACT

An apparatus for use with a masonry block. The apparatus includes a body part that is at least substantially planar, has a perimeter, has a front surface and an opposed rear surface. The apparatus also includes a ¼ block stop part extending from the front surface and a ½ block stop part extending from the rear surface, the body part being dimensioned and the stop parts being positioned and dimensioned such that, when the body part is operatively positioned in a first configuration with the ¼ block stop part abutting the block, the perimeter of the body part can be used to mark the block for a ¼ block cut and when the body part is operatively positioned in a second configuration with the ½ block stop part abutting the block, the perimeter of the body part can be used to mark the block for a ½ block cut.

6 Claims, 3 Drawing Sheets

MASON'S SPEED SQUARE

CROSS-REFERENCE TO RELATED APPLICATIONS

This application claims priority to U.S. Provisional Application No. 61/602,258, filed Feb. 23, 2012, which is herein incorporated by reference.

BACKGROUND OF THE INVENTION

1. Field of the Invention

The present invention relates to the field of masonry.

2. Prior Art

Although blocks of varied sizes, i.e. ½ blocks, ¼ blocks, etc., are widely available, it is commonplace for masons to cut bricks in the field. This reduces their need to transport and inventory specialized bricks.

SUMMARY OF THE INVENTION

Forming one aspect of the invention is apparatus for use with a masonry block.

The apparatus comprises:

- a body part that is at least substantially planar, has a perimeter, has a front surface and an opposed rear surface;
- a ¼ block stop part extending from the front surface; and
- a ½ block stop part extending from the rear surface The body part is dimensioned and the stop parts are positioned and dimensioned such that when the body part is operatively positioned:

- in a first configuration with the ¼ block stop part abutting the block, the perimeter of the body part can be used to mark the block for a ¼ block cut; and
- in a second configuration with the ½ block stop part abutting the block, the perimeter of the body part can be used to mark the block for a ½ block cut.

According to other aspects:

- the perimeter of the body part can define a pair of spaced-apart end edges;
- when the body part is operatively positioned in the first configuration, the one of the end edges can be used to mark the block for the ¼ block cut; and
- when the body part is operatively positioned in a second configuration, the one of the end edges can be used to mark the block for the ½ block cut.

According to other aspects:

- the body part can be operatively positioned in a third configuration with the ¼ block stop part abutting the block and the other of the end edges can be used to mark the block for a 150:250 block cut; and
- the body part can be operatively positioned in a fourth configuration with the ½ block stop part abutting the block and the other of the end edges can be used to mark the block for a 50:350 block cut.

According to another aspect:

- the perimeter of the body part can defines a pair of spaced-apart side edges
- the body part can have defined therewithin a rectangular aperture
- the body part can be operatively positioned, in a fifth configuration of the apparatus, against the a side of the block with the one of the ends of the body part aligned with the bottom of the block and one of the side edges aligned with an end of the block, and so configured, the rectangular aperture can be used to mark the block for a single gang receptacle cut-out.

According to another aspect, the rectangular aperture can have the dimensions of a single gang receptacle cut-out.

According to another aspect, the body part can have defined therewithin, on opposite sides of the rectangular aperture, a pair of slots, the slots being shaped and dimensioned such that, when the body part is operatively positioned, in the fifth configuration of the apparatus, the slots can be used to mark the side edges of a hexagonal box cut-out and the edge of the rectangular aperture nearest the one end of the body member can be used to mark the base edge of the hexagonal box cut-out.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION OF THE PREFERRED EMBODIMENTS

Figure 1:
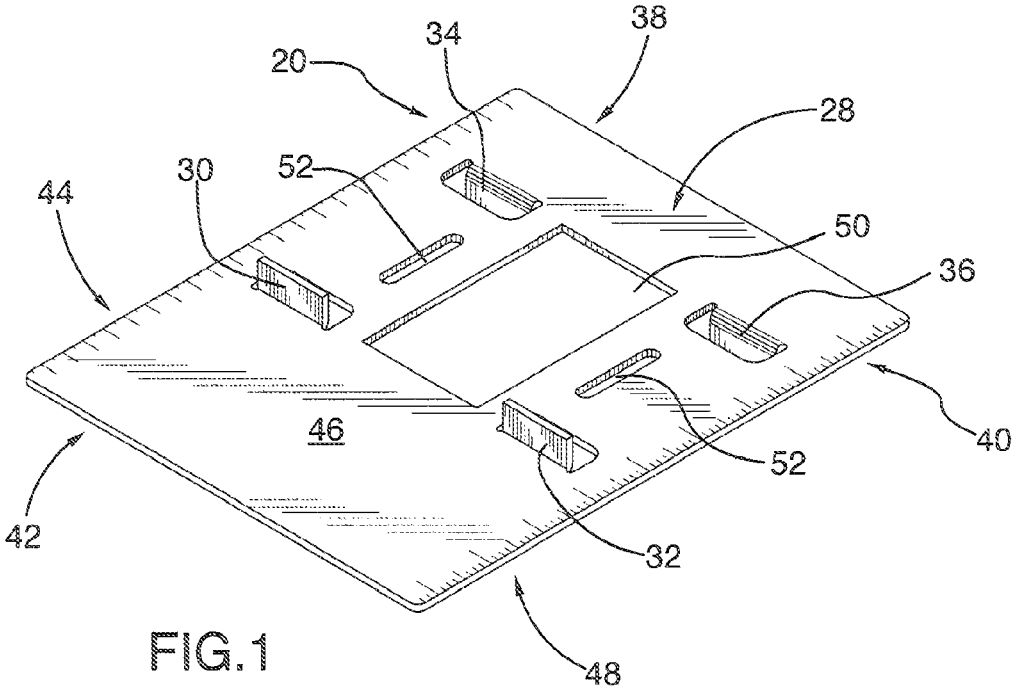
FIG. 1 is a perspective view of apparatus according to the exemplary embodiment.
Figure 2:
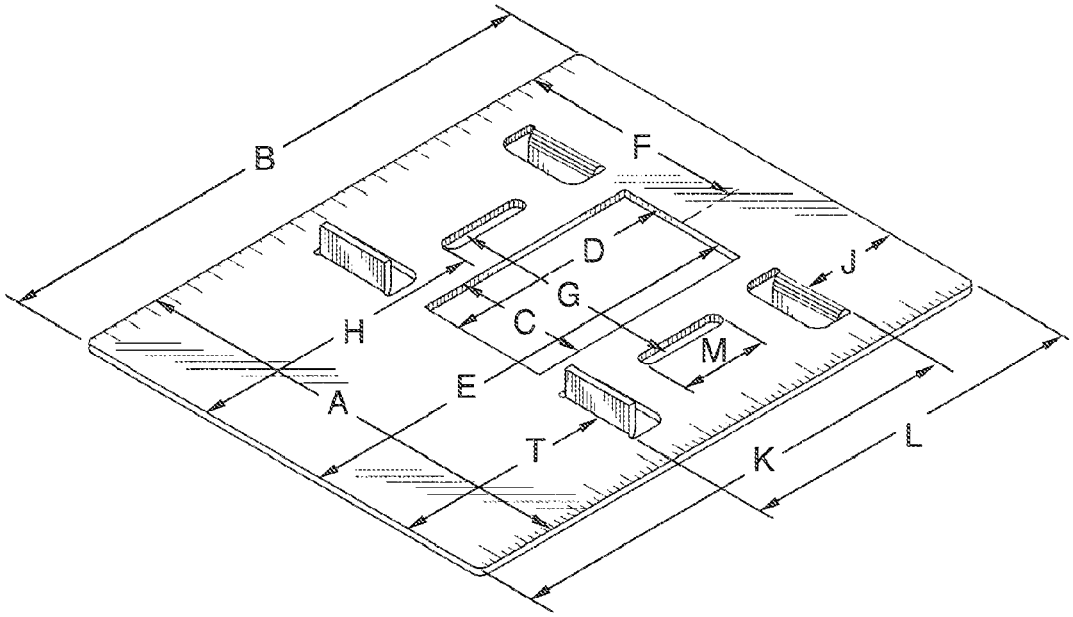
FIG. 2 is a view similar to FIG. 1.

Apparatus 20 according to the exemplary embodiment of the invention is shown in FIG. 1 and FIG. 2 and is described hereinafter in detail.

Figure 4:
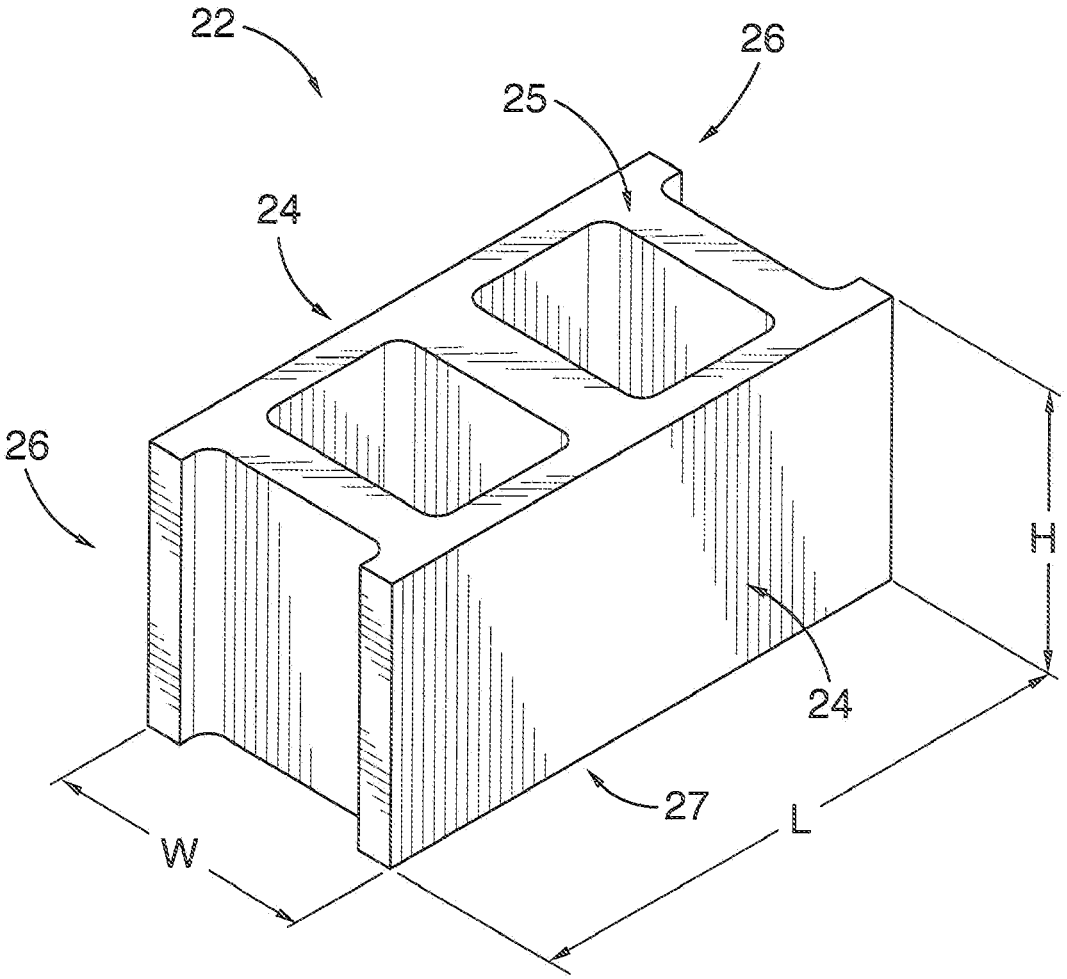
PRIOR ART FIG.4
FIG. 4 is a perspective view of a prior art block.

However, as an initial matter, reference is made to FIG. 4, which shows a concrete block 22 with which the invention can be used. The block 22, which forms no part of the invention and is illustrated herein for ease of reference only, will be seen to be of the type having a height H; a width W; a length L; sides 24,24 defined by the dimensions H and L; ends 26,26 defined by the dimensions H and W; and a top 25 and bottom 27, each defined by the dimensions W and L.

Turning now to FIG. 1 and FIG. 2, the apparatus 20 will be seen to comprise a body part 28 and four tabs 30,32,34,36.

The body part 28, which is planar and rectangular and is defined by a sheet of rigid plastic: has a perimeter 38,40,42,44 and opposed front 46 and rear 48 surfaces; and has defined therewithin a rectangular aperture 50 and, on opposite sides of the rectangular aperture 50, a pair of slots 52 spaced-apart from one another a distance G. The perimeter 38,40,42,44 of the body part 28 defines a pair of end edges 38,42 spaced-apart a distance B and a pair of side edges 40,44 spaced apart a distance A.

The rectangular aperture 50 has the dimensions C, D of a single gang receptacle cut-out, has a centreline that is spaced-apart from side edges 40,44 a distance F and extends to an edge that is a distance E from end edge 42. Each slot 52 has a length M that is the same length as the side of a hexagonal receptacle box cut-out and is spaced a distance H from end edge 42.

Two of the four tabs 30,32 extend from the front surface 46 and define a ¼ block stop part; the other two of the four tabs 34,36 extend from the rear surface 48 and define a ½ block stop part. ¼ block stop part 30,32 is spaced a distance I from end edge 42 and a distance L from end edge 38; ½ stop part 34,36 is spaced a distance J from end edge 38 and a distance K from end edge 42.

In the case of a conventional imperial block, wherein H=7⅝", W=7⅝" and L=15⅝", the dimensions of the exemplary apparatus are as follows:

| |
|---|
| A ≈ 7½" |
| B ≈ 9⅜" |
| C ≈ 2⅛" |
| D ≈ 3 13/16" |
| E ≈ 7⅝" |
| F ≈ 3¾" |
| G ≈ 3¾" |
| H ≈ 5" |
| I ≈ 3⅝" |
| J ≈ 1 11/16" |
| K ≈ 7⅝" |
| L ≈ 5⅝" |
| M ≈ 1½" |

Figure 3A:
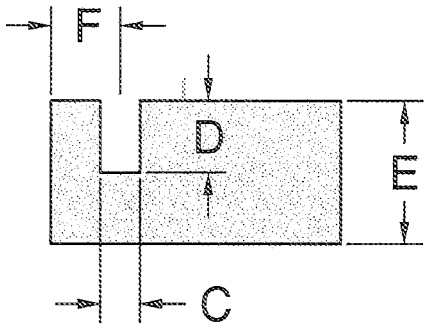
FIG. 3A is a schematic view showing a single-gang receptacle box cut-out in a block.

This set of dimensions permits the apparatus 20 to be positioned as follows:

in a first configuration: in this configuration, the front face 46 of the body part 28 abuts one of the sides of a block; the ¼ block stop part 30,32 abuts the end of that block; and end edge 42 overlies the block and can be used to mark the block for a ¼:¾ A block cut in a second configuration: in this configuration, the rear face 48 of the body part 28 abuts one of the sides of a block; the ¼ block stop part 34,36 abuts the end of that block; and end edge 42 overlies the block and can be used to mark the block for a ½:½ block cut in a third configuration: in this configuration, the front face 46 of the body part 28 abuts one of the sides of a block; the ¼ block stop part 30,32 abuts the end of that block; and end edge 38 can be used to mark the block for a 150:250 block cut in a fourth configuration: in this configuration, the rear face 48 of the body part 28 abuts one of the sides of a block; the ½ block stop part 34,36 abuts the end of that block; and end edge 38 can be used to mark the block for a 50:350 block cut in a fifth configuration: in this configuration, the rear surface 48 is disposed against one of the sides of the block; end edge 42 is aligned with the bottom surface of the block; and one of side edges 40,44 is aligned with an end of the block. In this configuration: (1) the aperture 50 can be used to mark the block for a single gang receptacle cut-out; or (2) the slots 52 can be used to mark the side edges of a hexagonal box cut-out and the edge of the aperture 50 nearest end edge 42 of the body member can be used to mark the base edge of the hexagonal box cut-out in a sixth configuration: in this configuration, the rear face 48 of the body part 28 abuts one of the sides of a block; the ½ block stop part 34,36 abuts the top of that block; and end edge 38 can be used to mark the block for a ¼ ashlar cut in a seventh configuration: in this configuration, the front face 46 of the body part 28 abuts one of the sides of a block; the ¼ block stop part 30,32 abuts the top of that block; and end edge 42 overlies the block and can be used to mark the block for a ½ ashlar cut Reference is now made to FIGS. 3A-3H, which show the various dimensions of the apparatus overlaid upon blocks to clarify the above uses:

FIG. 3A shows a single gang receptacle box cut-out

Figure 3B:
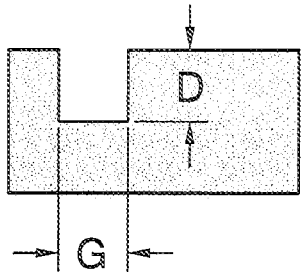
FIG. 3B is a schematic view showing a double-gang receptacle box cut-out in a block.

FIG. 3B shows a double gang receptacle box cut-out

Figure 3C:
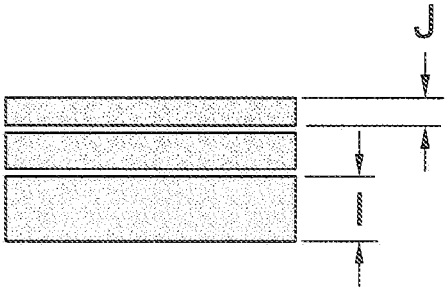
FIG. 3C is a schematic view showing a block cut into ashlars.
Figure 3D:
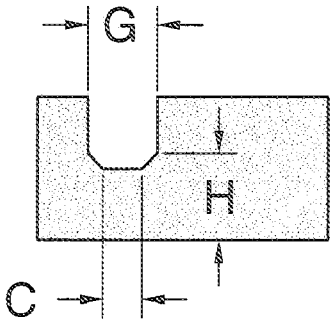
FIG. 3D is a schematic view showing a hexagonal receptacle box cut-out in a block.
Figure 3E:
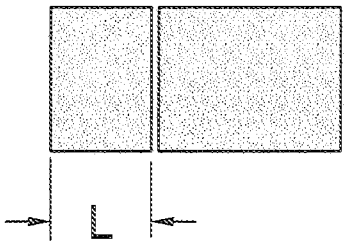
FIG. 3E is a schematic view showing a 150:250 block cut.
Figure 3F:
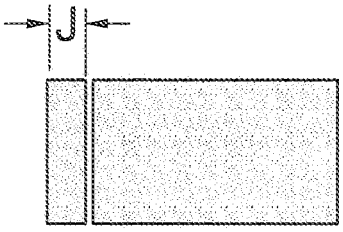
FIG. 3F is a schematic view showing a 50:350 block cut.
Figure 3G:
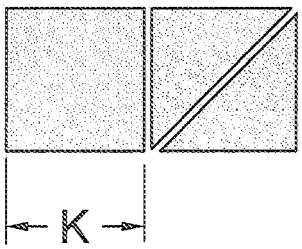
FIG. 3G is a schematic view showing a half-block and mitre cuts
Figure 3H:
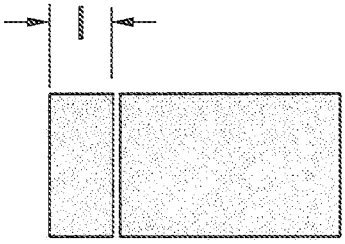
FIG. 3H is a schematic view showing a ¼:¾ block cut.

FIG. 3C shows a block split into a half-height ashlar and two quarter-height ashlars FIG. 3D shows a hexagonal receptacle box cut-out FIG. 3E shows a 150:250 cut FIG. 3F shows a 50:250 cut FIG. 3G shows a half-block and mitre cuts FIG. 3H shows a ¼:¾ cut Whereas but a single embodiment of the invention is shown, it will be evident that variations are possible. Foremost, the dimensions of the apparatus will vary with the size of the blocks with which it is used. As well, whereas the illustrated device is constructed of plastic, this is not necessary; the apparatus could easily be construed out of stamped metal. Further, whereas each stop in the illustrated device is defined by a pair of tabs, this also is not necessary; each stop could similarly be defined by, for example, a continuous ridge. Yet further modifications are possible. Accordingly, it should be understood that invention is to be limited only by the claims appended hereto, purposively construed.

What is claimed is:

1. Apparatus for use with a masonry block of the type having: a height H; a width W; a length L; sides defined by the dimensions H and L; and ends defined by the dimensions H and W, the apparatus comprising:

a body part that is at least substantially planar, has a perimeter, has a front surface and an opposed rear surface;

a ¼ block stop part extending from the front surface; and a ½ block stop part extending from the rear surface, the body part being dimensioned and the stop parts being positioned and dimensioned such that, when the body part is operatively positioned in a first configuration with the ¼ block stop part abutting the block, the perimeter of the body part can be used to mark the block for a ¼ block cut; and when the body part is operatively positioned in a second configuration with the ½ block stop part abutting the block, the perimeter of the body part can be used to mark the block for a ½ block cut.

2. Apparatus according to claim 1, wherein: the perimeter of the body part defines a pair of spaced-apart end edges; when the body part is operatively positioned in the first configuration, the one of the end edges can be used to mark the block for the ¼ block cut; and when the body part is operatively positioned in a second configuration, the one of the end edges can be used to mark the block for the ½ block cut.

3. Apparatus according to claim 2, wherein when the body part is operatively positioned in a third configuration with the ¼ block stop part abutting the block, the other of the end edges can be used to mark the block for a 150:250 block cut; and when the body part is operatively positioned in a fourth configuration with the ½ block stop part abutting the block, the other of the end edges can be used to mark the block for a 50:350 block cut.

4. Apparatus according to claim 2, wherein the perimeter of the body part defines a pair of spaced-apart side edges; and the body part has defined therewithin a rectangular aperture, when the body part is operatively positioned in a fifth configuration against the front surface of the block with the one of the ends of the body part aligned with the bottom of the block and one of the side edges aligned with an end of the block, the rectangular aperture can be used to mark the block for a single gang receptacle cut-out.

5. Apparatus according to claim 4, wherein the rectangular aperture has the dimensions of a single gang receptacle cut-out.

6. Apparatus according to claim 5, wherein the body part has defined therewithin, on opposite sides of the rectangular aperture, a pair of slots, the slots being shaped and dimensioned such that, when the body part is operatively positioned in the fifth configuration, the slots can be used to mark the side edges of a hexagonal box cut-out and the edge of the rectangular aperture nearest the one end of the body member can be used to mark the base edge of the hexagonal box cut-out.

* * * * *